US006086216A

United States Patent [19]

Goldfarb

[11] Patent Number: 6,086,216

[45] Date of Patent: Jul. 11, 2000

[54] BOTTLE LANTERN

[76] Inventor: Eric A. Goldfarb, 409 Little Silver Point Rd., Little Silver, N.J. 07739

[21] Appl. No.: 09/218,187

[22] Filed: Dec. 22, 1998

[51] Int. Cl.[7] ..... F21V 33/00

[52] U.S. Cl. ..... 362/101; 362/96; 362/154

[58] Field of Search ..... 362/101, 96, 154, 362/311

[56] References Cited

U.S. PATENT DOCUMENTS

| | | | |
|---|---|---|---|
| D. 291,011 | 7/1987 | Fleming . | |
| 2,547,450 | 4/1951 | Du Pont | 362/96 X |
| 3,586,472 | 6/1971 | Clifton . | |
| 3,617,733 | 11/1971 | Adams . | |
| 4,004,132 | 1/1977 | Glass et al. . | |
| 4,268,894 | 5/1981 | Bartunek . | |
| 4,338,075 | 7/1982 | Bemm . | |
| 4,758,084 | 7/1988 | Tokumi et al. . | |
| 4,954,075 | 9/1990 | Francino . | |
| 5,044,509 | 9/1991 | Petrosky et al. . | |
| 5,133,145 | 7/1992 | McDonald . | |
| 5,178,450 | 1/1993 | Zelensky et al. | 362/154 |
| 5,489,987 | 2/1996 | Ringlien . | |
| 5,523,560 | 6/1996 | Manique et al. . | |
| 5,662,406 | 9/1997 | Mattice et al. | 362/101 |
| 5,682,574 | 10/1997 | Oshida et al. . | |
| 5,938,318 | 8/1999 | Mattsen | 362/101 X |

OTHER PUBLICATIONS

*Backpacker, The Magazine of Wilderness Travel,* Aug./1998 edition; Article: "Pac–Lite Lantern Kit" by J. Dorn.

*Primary Examiner*—Sandra O'Shea
*Assistant Examiner*—Peggy A Neils
*Attorney, Agent, or Firm*—Duane, Morris & Heckscher LLP

[57] ABSTRACT

The present invention provides a portable lighting device comprising a water bottle formed of a light transmitting material and a lamp case fitted to the open end of the water bottle. A light bulb is positioned within the lamp case and a light transmitting lens is positioned between the light bulb and the interior of the water bottle whereby light emitted from the light bulb is transmitted through the lens to the interior of the water bottle and is diffused through the wall of the water bottle. A method for illuminating a space is provided in which water is introduced into a bottle so that the bottle is at least partially filled and the bottle is sealingly and releasably attached to a source of light.

18 Claims, 12 Drawing Sheets

BOTTLE LANTERN

BACKGROUND OF THE INVENTION

1. Field of the Invention

The invention relates to the field of portable lighting equipment, and in particular concerns portable "hands free" or ambient lighting.

2. Prior Art

Campers very often will bring along their own potable beverages, e.g., water, and often carry bottles of potable water with them, adding to the overall weight of the pack load. Campers and backpackers also often employ flashlights, small headlamps or candles for light. However, a camper or backpacker will make every effort to minimize weight and, therefore, wherever possible will not choose to carry bulky ambient lighting sources, i.e., bulky lanterns. Campers do not usually carry more water than can be held in their water bottle. They often only carry two (2) bottles due to space and weight concerns. Normally, this bottled water supply is replenished, using iodine tablets, hand operated pump/filters, etc. The camper fills and purifies water at every opportunity. Still, water is precious because the camper will often not know when his next opportunity for replenishing his supply will occur. The ability to make dual use of a bottle for storing water and as a part of a lantern in any configuration without emptying the valuable water would be a significant advantage to a camper.

Dual purpose camping equipment is well known in the art. For example, U.S. Pat. No. 4,954,075 provides a camp stove/lantern that is adapted to provide a combination lighting and cooking device by converting a portable cooking stove into an illumination device. Devices such as Francino's provide dual-purpose efficiency of equipment which allows the camper or backpacker to physically carry more equipment needed for comfortable camping then would otherwise be possible. One aim of the design of such equipment is to minimize both the weight and the size of the backpacker's load while still providing utility in the equipment.

A need exists for a practical and efficient hands free, ambient lighting system which takes advantage of equipment already normally carried by a camper or backpacker, e.g., a water bottle, but provides ample and adequate ambient light for use at a campground and preserves and protects the camper's water supply.

SUMMARY OF THE INVENTION

The present invention provides a portable lighting device comprising a water bottle having an open end and formed of a light transmitting material, a lamp case fitted to the open end of the water bottle, a light bulb positioned within the lamp case, and a light transmitting lens positioned between the light bulb and the interior of the water bottle whereby light emitted from the light bulb is transmitted through the lens to the interior of the water bottle and is diffused through the wall of the water bottle.

A method for illuminating a space is also provided in which water is introduced into a bottle so that the bottle is at least partially filled and the bottle is sealingly and releasably attached to a source of light.

BRIEF DESCRIPTION OF THE DRAWINGS

These and other features and advantages of the present invention will be more fully disclosed in, or rendered obvious by, the following detailed description of the preferred embodiment of the invention, which is to be considered together with the accompanying drawings wherein like numbers refer to like parts and further wherein.

DETAILED DESCRIPTION OF THE PREFERRED EMBODIMENTS

The following description of the preferred embodiments of the invention are intended to be read in connection with the foregoing drawings and are to be considered a portion of the entire written description of this invention. As used in the following description, the terms "horizonal", "vertical", "left", "right", "up", and "down", as well as adjectival and adverbial derivatives thereof (e.g., "horizontally", "rightwardly", "upwardly", etc.) simply refer to the orientation of the structure of the invention as it is illustrated in the particular drawing figure when that figure faces the reader. Similarly, the terms "inwardly" and "outwardly" generally refer to the orientation of a surface relative to its axis of elongation, or axis of rotation, as appropriate. Also, the terms "connected" and "interconnected," when used in this disclosure to describe the relationship between two or more structures, means that such structures are secured or attached to each other either directly or indirectly through intervening structures, and includes pivotal connections. The term "operatively connected" means that the foregoing direct or indirect connection between the structures allows such structures to operate as intended by virtue of such connection.

Figure 1:
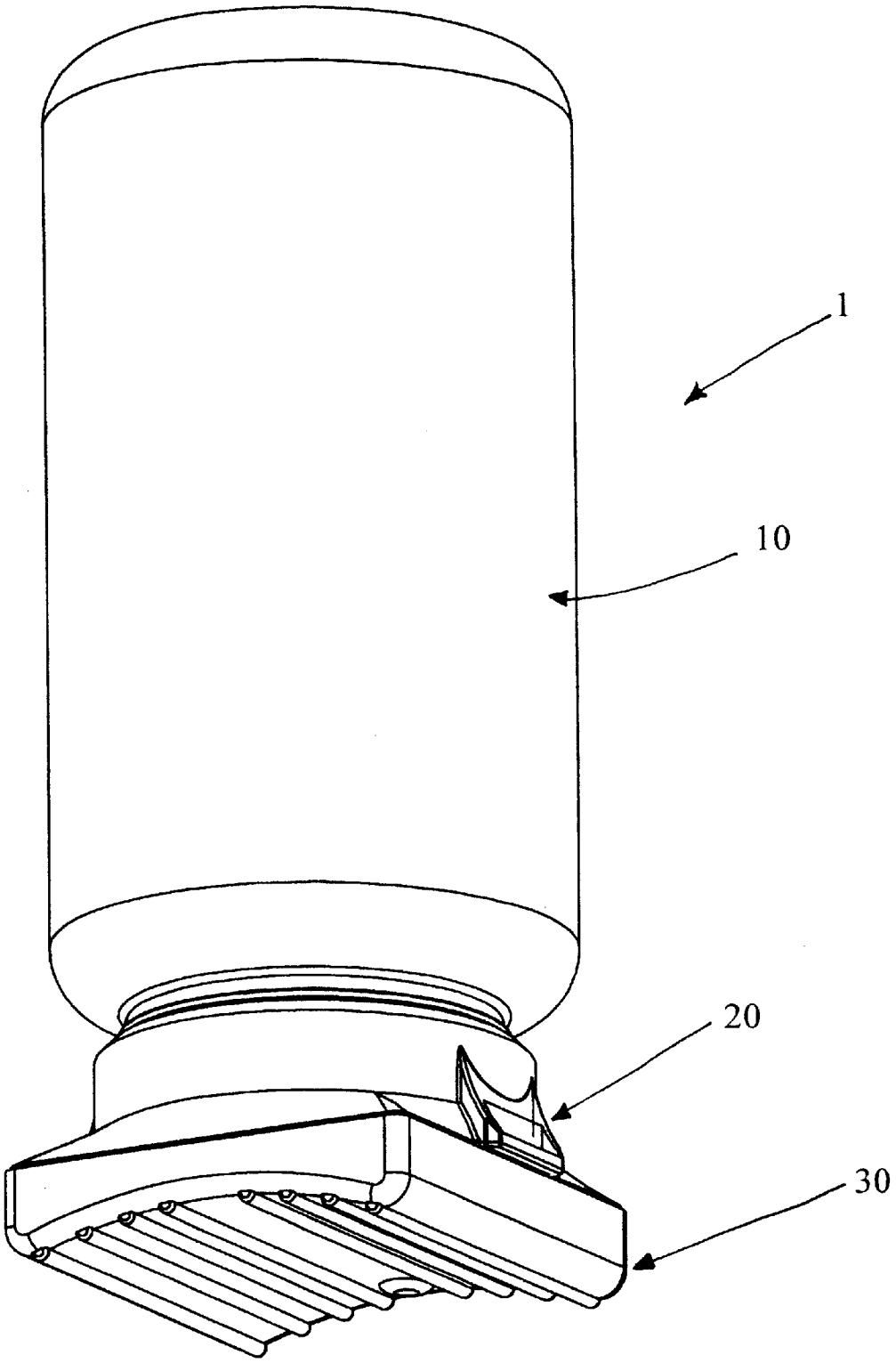
FIG. 1 is a perspective view of a bottle lantern formed in accordance with the present invention.
Figure 1A:
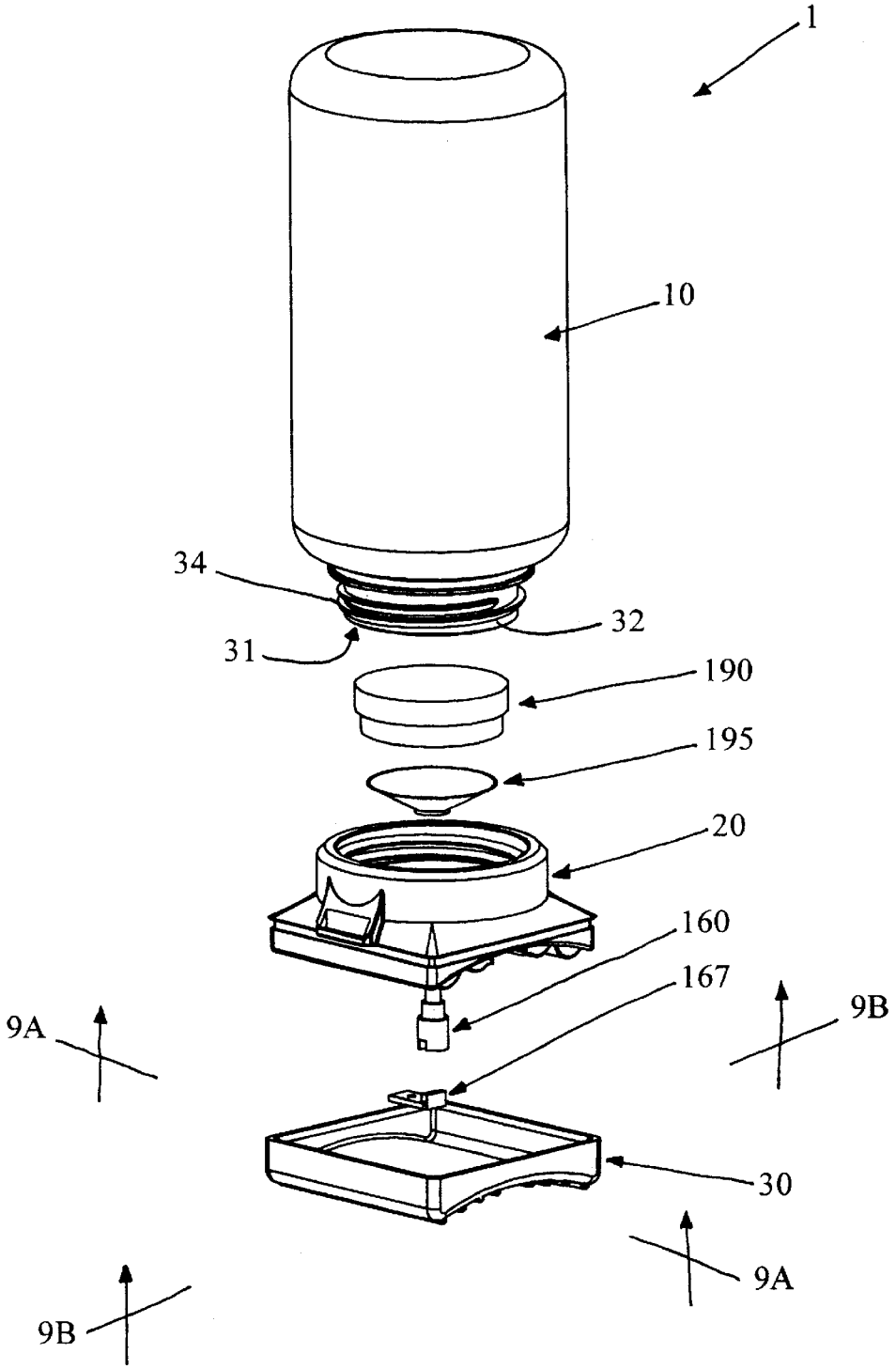
FIG. 1A is an exploded perspective view of the bottle lantern shown in FIG. 1.

Referring to FIGS. 1 and 1A, a bottle lantern 1 formed in accordance with the present invention comprises a bottle 10, a lamp case 20 and a battery cover 30. More particularly, bottle 10 comprises a conventional vessel for carrying liquids, having a generally cylindrical shape, and with one end closed. An open end 31 of bottle 10 defines a cylindrical mouth wall 32, having an external thread 34 that is adapted to engage a corresponding thread on the inner side surface of a cap or lid. Bottle 10 is preferably molded from one of the well known translucent polymers, e.g., polyethylene, polypropylene, etc. One type of bottle that has been found to work well with the present invention is the one manufactured by the Nalgene company for use in camping, biking, and other recreational activities.

Figure 2:
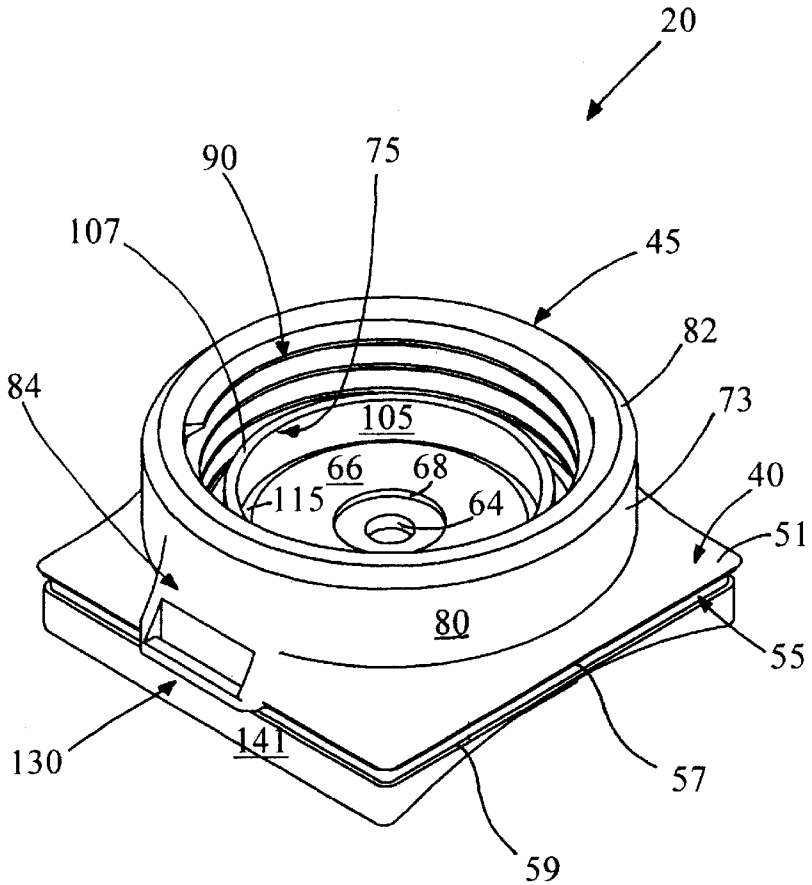
FIG. 2 is a perspective view of a lamp case.
Figure 3:
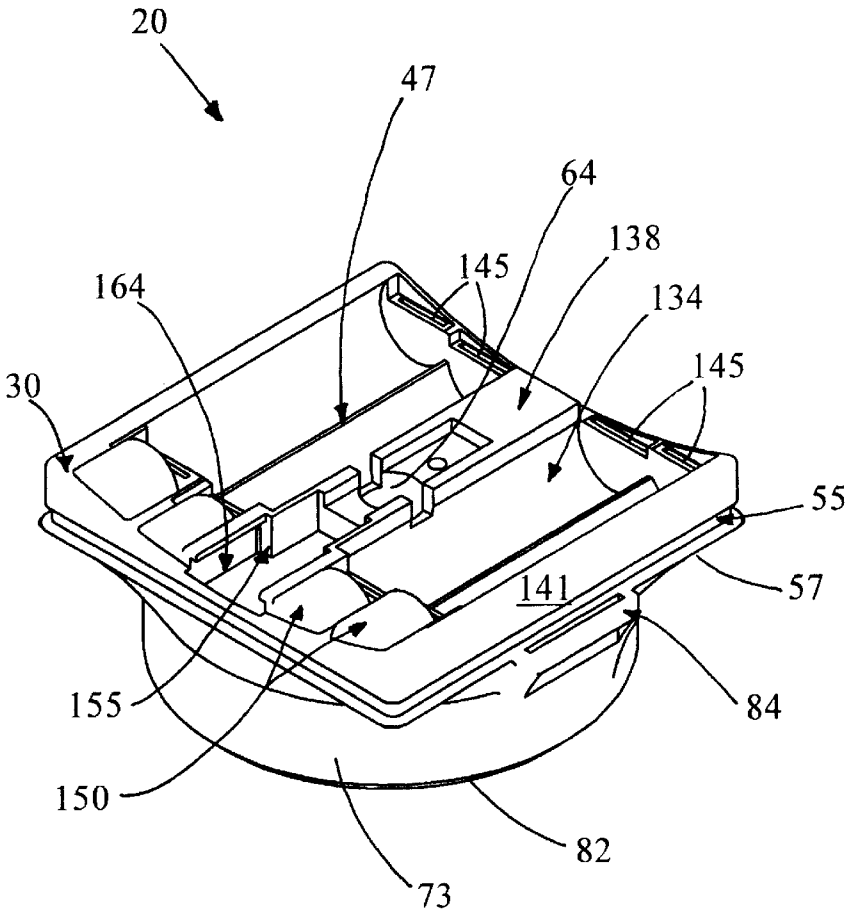
FIG. 3 is a perspective view of the lamp case shown in FIG. 2 but rotated about a transverse axis by 180° so as to show a battery receptacle.

Referring to FIGS. 1A, 2 and 3, lamp case 20 includes a base 40, a bottle receptacle 45, and a battery receptacle 47. More particularly, base 40 comprises a generally rectangularly shaped wall including a top side 51. An annular groove 55 is defined in the perimeter edge 57 of base 40, and forms an annular shoulder 59 on the outer surface of a portion of battery receptacle 47. Base 40 also has a centrally positioned through-bore 64 defined in a central bottom surface 66. An inner annular shoulder 68 is spaced radially-away from the edge of central bore 64.

Bottle receptacle 45 includes a cylindrical wall 73 and a cylindrical flange 75. Cylindrical wall 73 projects outwardly from first side 51 of base 40, and is disposed in radially spaced-relation to the edge of central bore 64 and inner annular shoulder 68. In this way, cylindrical wall 73 circumscribes bottom surface 66. Cylindrical wall 73 also defines an internal diameter that is sized and shaped to receive mouth wall 32 of bottle 10, as will hereinafter be disclosed in further detail. An outer surface 80 of cylindrical wall 73 includes a chamfered external edge 82. Conventional strap cleats 84 are formed in diametrically opposing relation to one another on outer surface 80. Strap cleats 84 may be used in a conventional manner to affix a strap or cord to bottle lantern 1 for carrying or mounting it, as required. Cylindrical wall 73 also defines an inner surface having a thread 90 that matingly corresponds to thread 34 disposed on the outer surface of mouth wall 32 of bottle 10.

Cylindrical flange 75 is constructed so as to project outwardly from first side 51 of base 40. Cylindrical flange 75 is disposed in annular relation to bottom surface 66. The inner surface 105 of cylindrical flange 75 extends from an outer edge 107 to top side 51. A recessed groove 115 is defined between the lower portion of inner surface 105 and bottom surface 66. The outer surface of cylindrical flange 75 includes a constant diameter portion 120 and a gradually increasing diameter portion that defines a ramp 125 (best shown in FIG. 5). The outer diameter of cylindrical flange 75 is typically smaller than the inner diameter of cylindrical wall 73.

Figure 5:
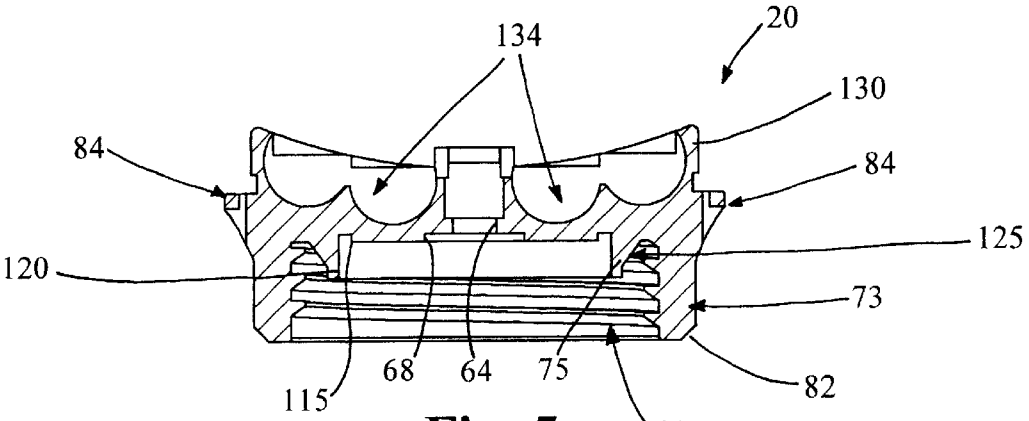
FIG. 5 is a side elevational sectional view as taken along line 5—5 in FIG. 4.
Figure 4:
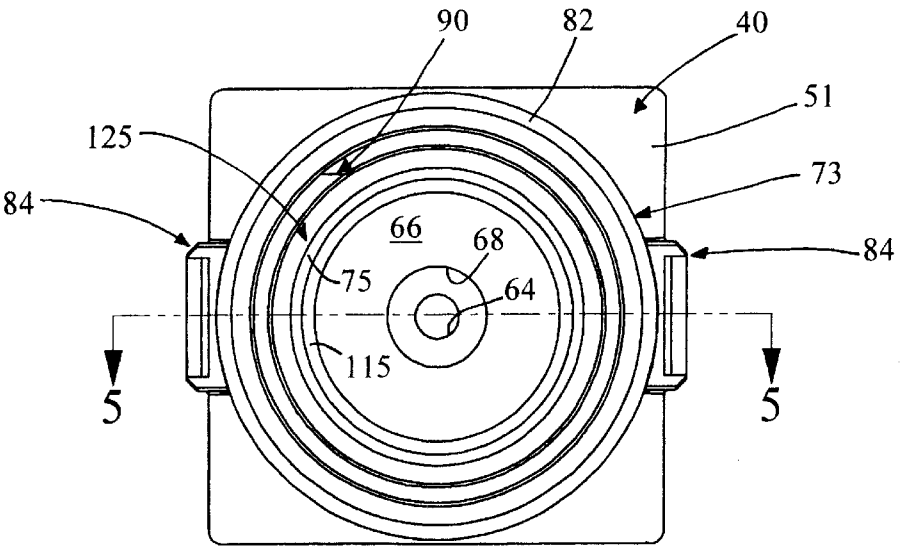
FIG. 4 is a top view of the lamp case shown in FIG. 2.

Referring to FIGS. 3 and 5, battery receptacle 47 includes a peripheral wall 130, a plurality of semicylindrically shaped recesses 134, and a wiring island 138. More particularly, peripheral wall 130 projects outwardly from the edge of base 40, and is disposed in radially spaced relation to the edge of central bore 64 so as to form a curved perimeter edge surrounding recesses 134. Annular shoulder 59 is disposed on outer surface 141 of peripheral wall 130 (FIG. 2). Plurality of semicylindrically shaped recesses 134 are defined in base 40 in paired, parallel-relation to one another, with wiring island 138 positioned between the pairs. Recesses 134 are sized and shaped to receive and retain standard cylindrically shaped batteries of the type that are well known in the art for providing electrical power to portable electric and electronic apparatus. Electrical contact cavities 145 are also provided for retaining and positioning electrical contacts that provide means for electrical interconnection between the batteries and a conventional wiring harness (not shown) disposed in wiring island 138.

Figure 5A:
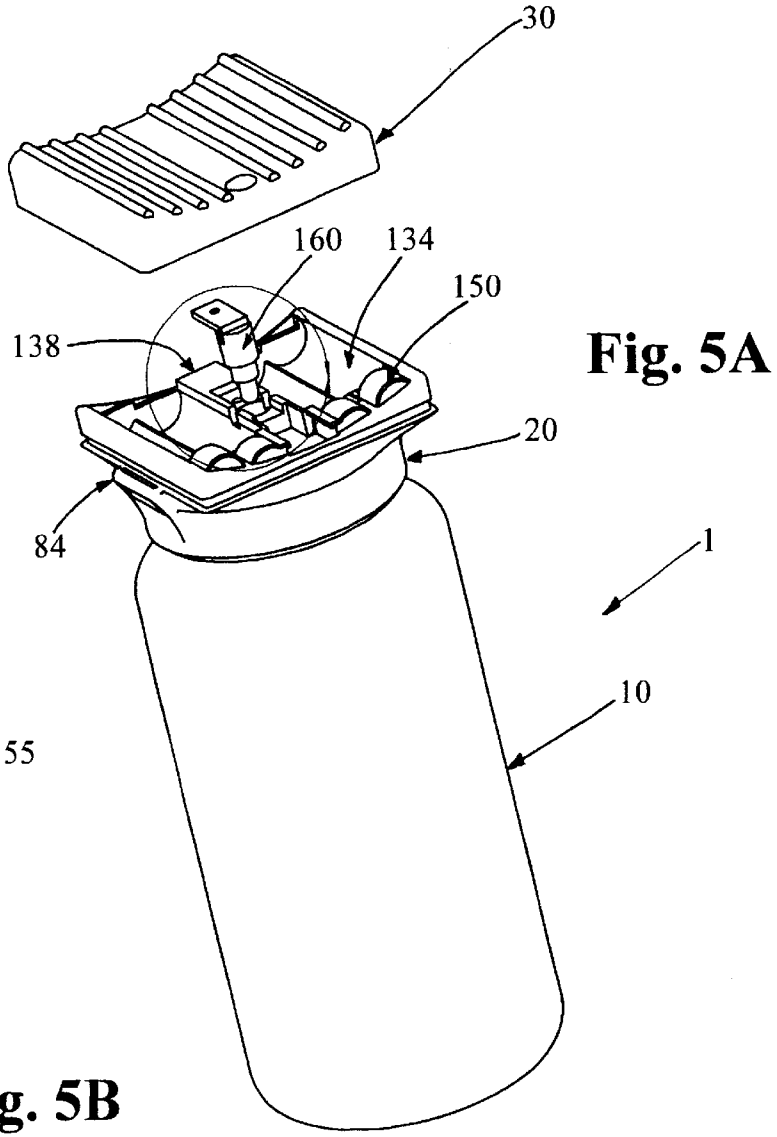
FIG. 5A is a perspective view of the bottle lantern shown in FIG. 1, with the battery cover and light bulb collet exploded away for clarity of illustration.

A plurality of semicylindrical bosses 150 are provided at one end of recesses 134 so as to create a uniform transition between the edges of the batteries and peripheral wall 130 during operation of bottle lantern 1. Central bore 64 opens through the center of wiring island 138, and structural means 155 are provided integral with wiring island 138 and adjacent to the edges defining central bore 64 for receiving a light bulb collet 160 (FIGS. 5A, 5B, and 9) and a conventional push button switch (not shown). A recess 164 is also adjacent to central bore 64 for receiving the conventional push button switch. Structural means 155 may take the form of molded-in shoulders, stops and voids in wiring island 138 that are adapted for receiving or engaging portions of a wiring harness, electrical contacts, the light bulb, or the push button switch.

Figure 9:
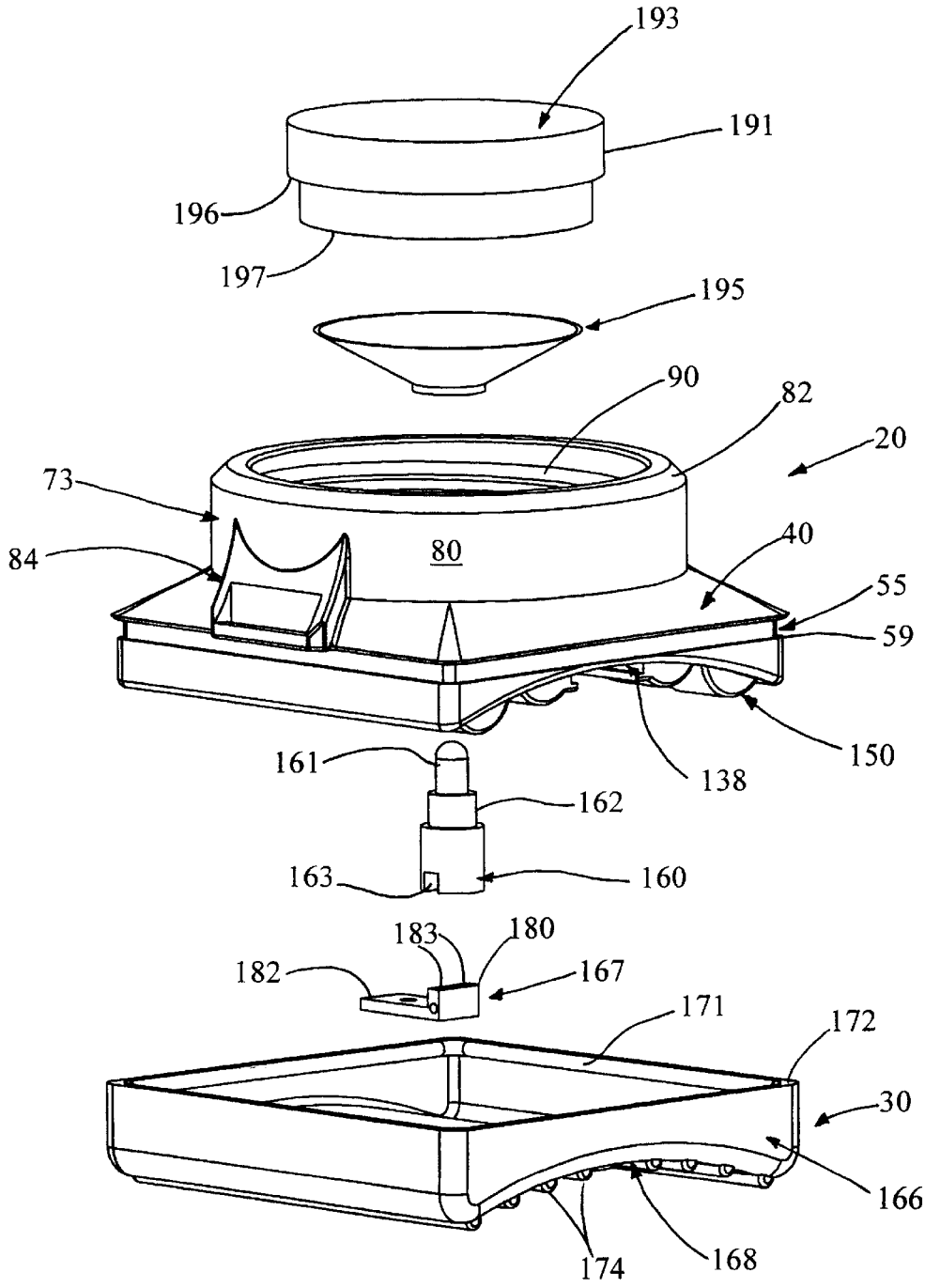
FIG. 9 is a perspective exploded view showing a lens, a reflector, a lamp case, a bulb collet, a wiring harness support, and battery cover just prior to assembly.
Figure 9A:
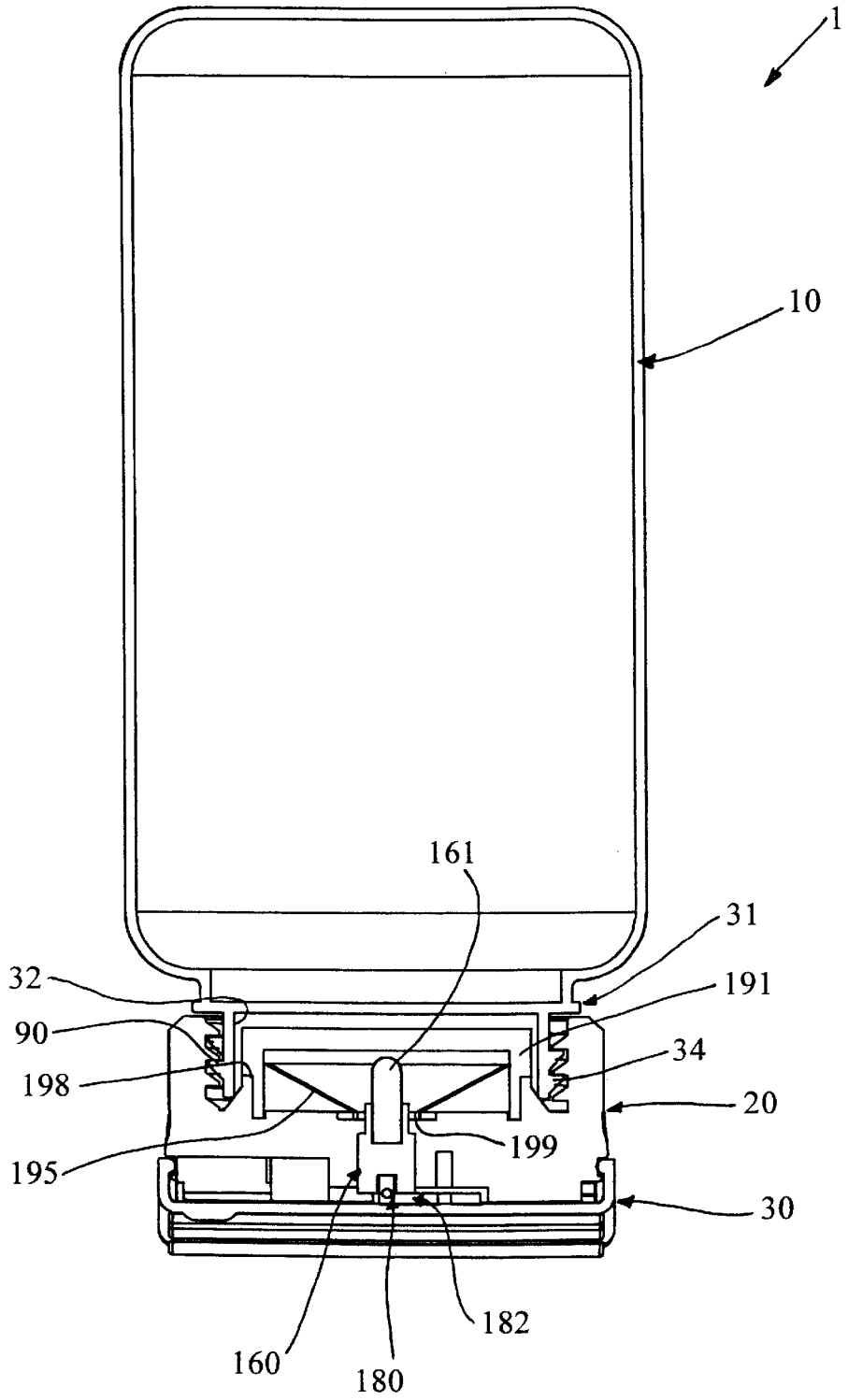
FIG. 9A is a cross-sectional view of the bottle lantern shown in FIGS. 1 and 1A, as taken along line 9A—9A in FIG. 1A.
Figure 9B:
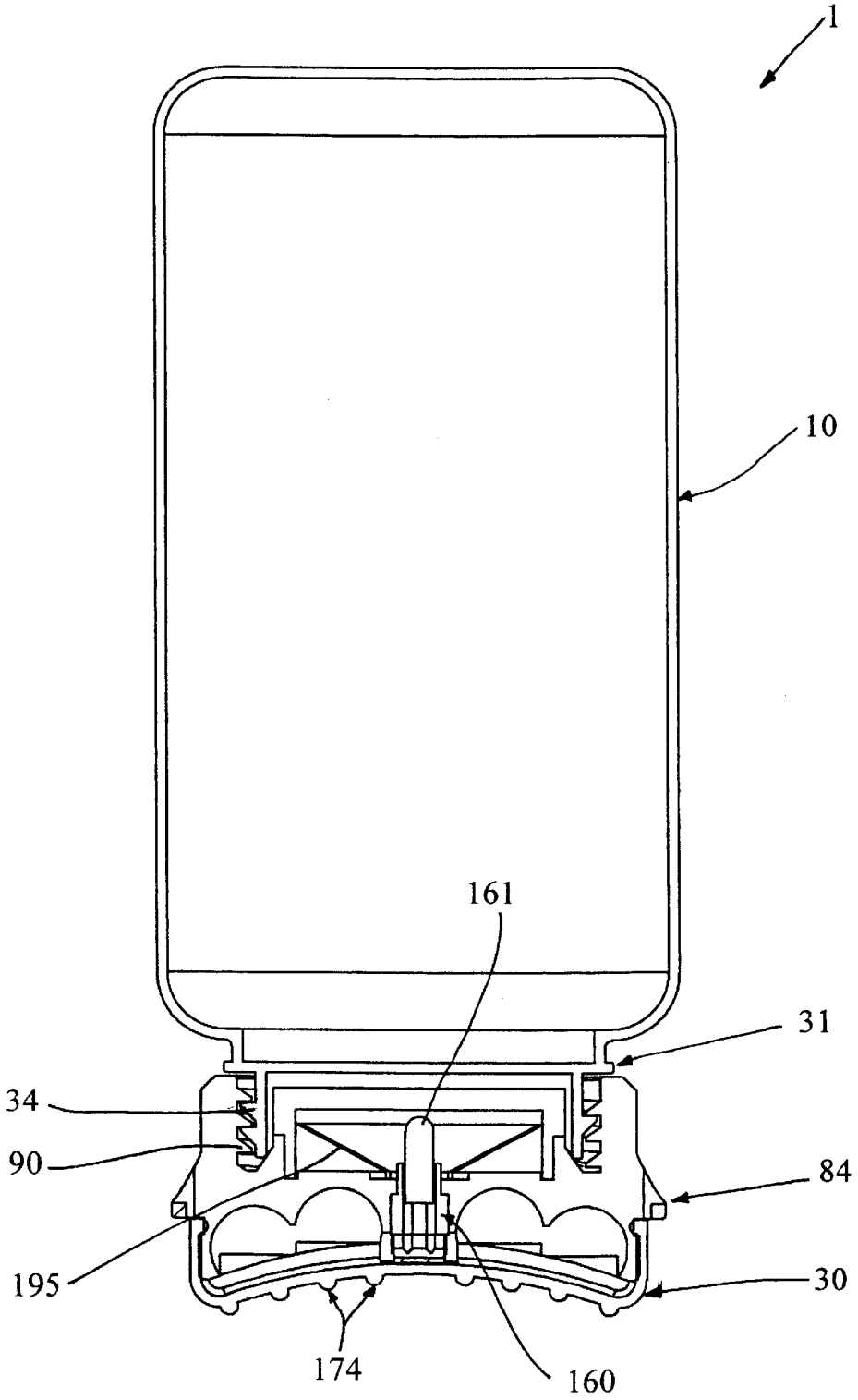
FIG. 9B is a cross-sectional view of the bottle lantern shown in FIGS. 1 and 1A, as taken along line 9B—9B in FIG. 1A.

Referring to FIG. 9, light bulb collet 160 comprises a generally cylindrical housing 162 that is adapted to receive and support a conventional light bulb 161. Housing 162 defines a diametrically aligned slot 163 positioned at one end and a socket for receiving light bulb 162 at the other end. Slot 163 is sized to receive a portion of wiring header 167. Wiring header 167 comprises a wire receptacle 180 and a wire guide 182. Wiring receptacle 180 is generally rectangular in shape and sized to be slidingly received within slot 163. A pair of bores 183 are formed in a top surface of wire receptacle 180, and exit from side surfaces of wire receptacle 180. Wire guide 182 projects outwardly from the bottom of wire receptacle 180. Wire guide 182 is generally rectangularly shaped and oriented so as to project outwardly in perpendicular-relation to the bottom of wire receptacle 180. Light bulb 161 is interconnected to the conventional wiring harness (not shown) in the following manner. Typically, light bulb 161 will include two wires projecting outwardly from its bottom surface in the conventional manner. These wires are threaded, one each, through bores 183 in wire receptacle 180. Each wire is passed through its bore until it projects outwardly from the sides of wire receptacle 180. The wires may then be interconnected to the conventional wiring harness in wiring island 138 by guiding each wire along the edge of wire guide 182 until it can be mated with a corresponding portion of the wiring harness.

Referring to FIGS. 6–9, battery cover 30 is formed from an elastomeric material, and includes a side wall 166, a concave panel 168, and a inner surface 170. More particularly, side wall 166 projects from the peripheral edge of concave panel 168, and includes a radially inwardly directed, hemispherically shaped bulbous projection 171 disposed adjacent to the inner side of a peripheral free edge 172. Concave panel 168 has formed on its surface a plurality of transversely oriented ribs 174 to provide for better engagement with a support surface, such as a rock, tree branch, forehead, etc. A raised actuator pad 176 is disposed at one end of concave panel 168. Side wall 166 defines within its perimeter a recessed area 178 that is bounded on four sides by side wall 166 and along its bottom by inner surface 170. Recessed area 178 is sized and shaped so as to receive all of battery receptacle 47.

Referring to FIGS. 9–12, lens housing 190 includes a cylindrical wall 191, a transparent face plate 193, and a reflector 195. More particularly, cylindrical wall 191 includes a first circular edge 196, a second circular edge 197, and a circumferential shoulder 198 formed in the outer surface of cylindrical wall 191. Transparent face plate 193 is sealingly secured to first circular edge 196 of cylindrical wall 191. Reflector 195 is formed within lens housing 190 so as to be disposed in confronting relation to transparent face plate 193. A centrally positioned through bore 199 is located in reflector 195 and sized and shaped to receive a light bulb.

Figure 5B:
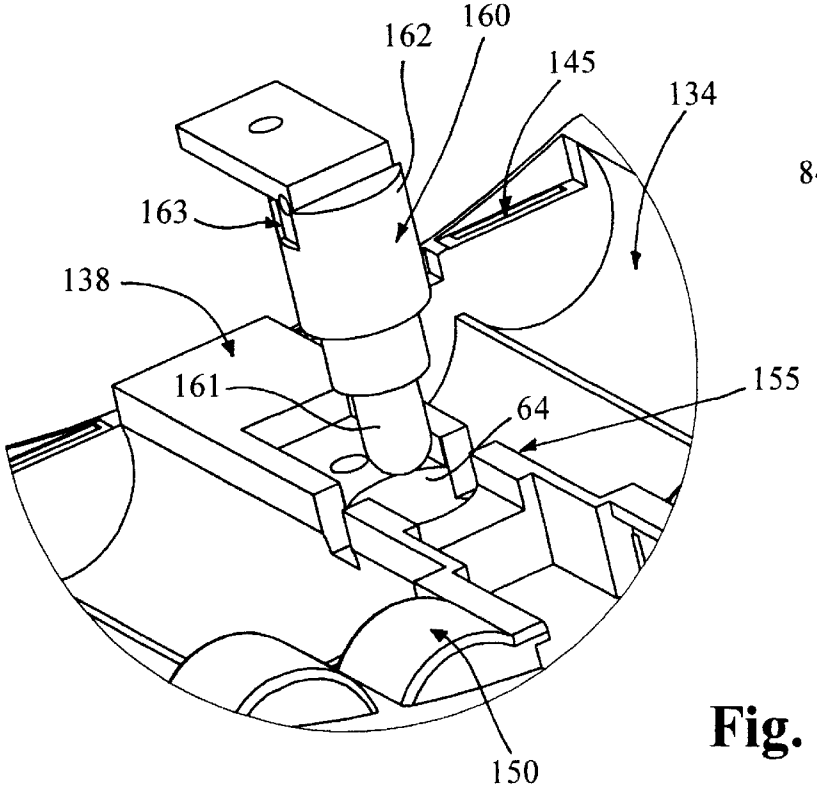
FIG. 5B is an enlarged and detailed portion of the light bulb collet and structural means adapted to support it.
Figure 7:
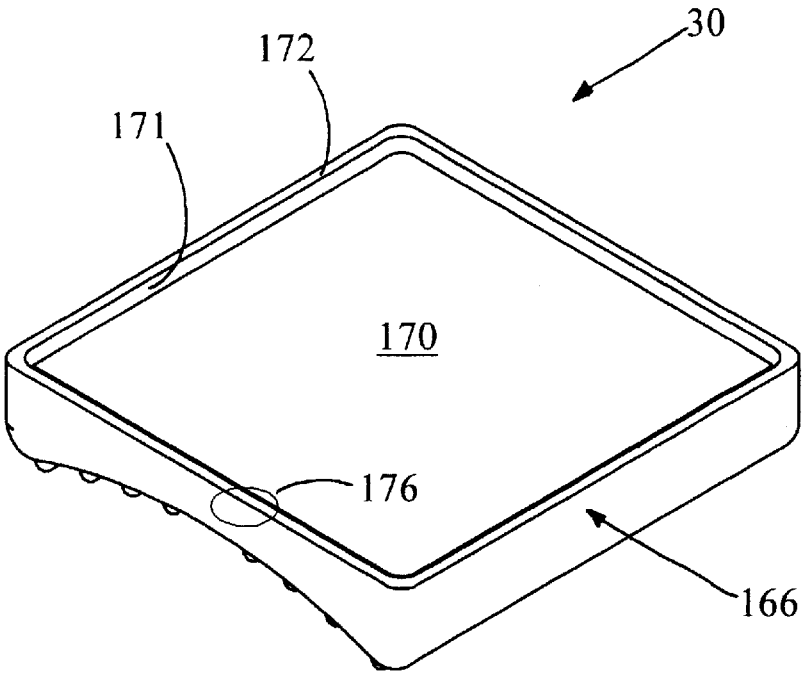
FIG. 7 is a perspective view of the battery cover shown in FIG. 6 but rotated about a transverse axis by 180°.
Figure 6:
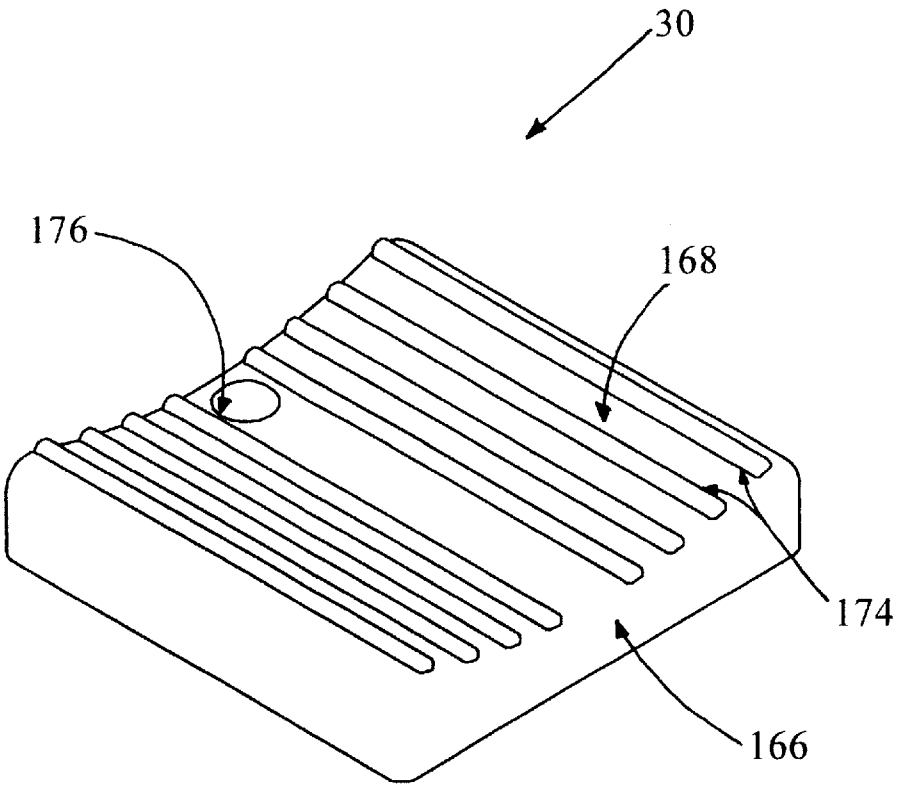
FIG. 6 is a perspective view of a battery cover.
Figure 8:
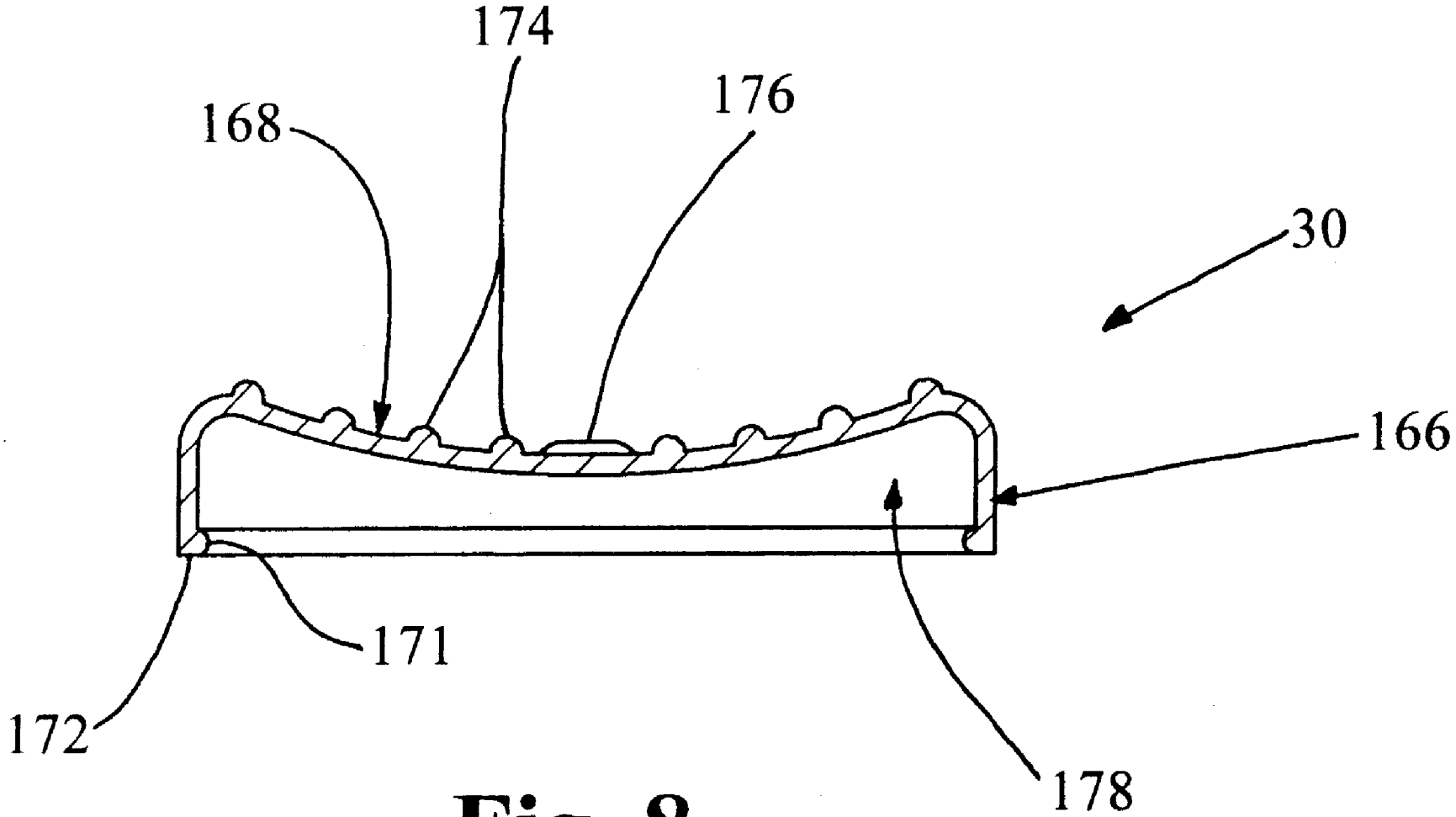
FIG. 8 is a side elevational cross-sectional view of the battery cover as taken along line 8—8 in FIG. 6.

Bottle lantern 1 is assembled in the following manner. Referring to FIGS. 1A, 9, 9A, and 9B bottle lantern 1 is assembled by mounting battery cover 30, light bulb collet 160, and lens housing 170 to lamp case 20. More particularly, batteries are first placed in semicylindrically shaped recesses 134 of battery receptacle 47, where they engage means for electrically interconnecting them with a conventional wiring harness disposed within wiring island 138. Light bulb collet 160 has assembled to it a conventional light bulb 161. Light bulb collet 160 is then oriented so that light bulb 161 is oriented in confronting coaxial relation with central bore 64 of lamp case 20. Once in this position, light bulb collet 160 is moved toward lamp case 20 until light bulb 161 is positioned above inner annular shoulder 68 and central bottom surface 66 of lamp case 20. Structural means 155 provide for fastening engagement of light bulb collet 160 within lamp case 20 (FIG. 5B).

With a light bulb and batteries fastened within lamp case 20 battery cover 30 is then slipped over battery receptacle 47 of lamp case 20. More particularly, battery cover 30 is oriented such that inner surface 170 is positioned in confronting relation to battery receptacle 47. In this position, battery cover 30 is arranged so that side wall 166 is positioned in confronting parallel relation to peripheral wall 130 of battery receptacle 47. Once in this position, battery cover 30 is moved toward battery receptacle 47. As peripheral free edge 172 of side wall 166 engages and slides along outer surface 141 of peripheral wall 130, bulbous projection 171 on the inner side of free edge 172 slips, mates with and fills over annular 55 on the outer surface of perimeter edge 57 thereby releasably attaching battery cover 30 to lamp case 20. Battery cover 30 protects the batteries by providing for water resistance during use of bottle lantern 1.

Figure 11:
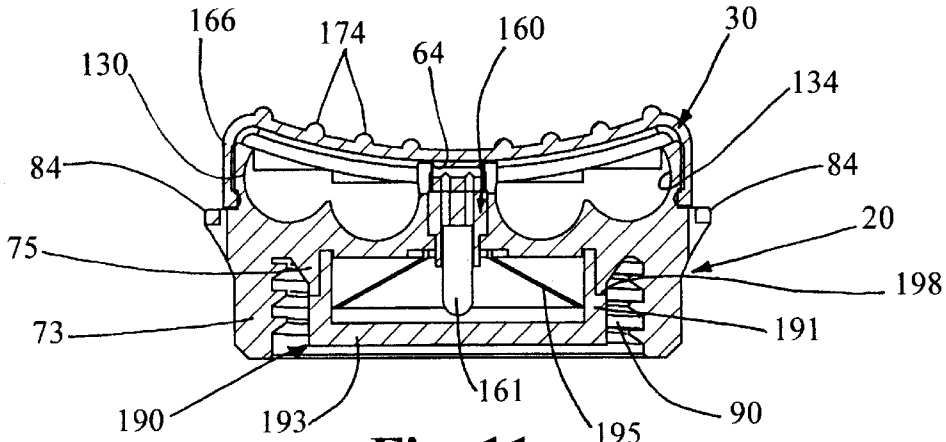
FIG. 11 is a side elevational cross-sectional view of the lamp case shown in FIG. 10, as taken along line 11—11 in FIG. 10.
Figure 10:
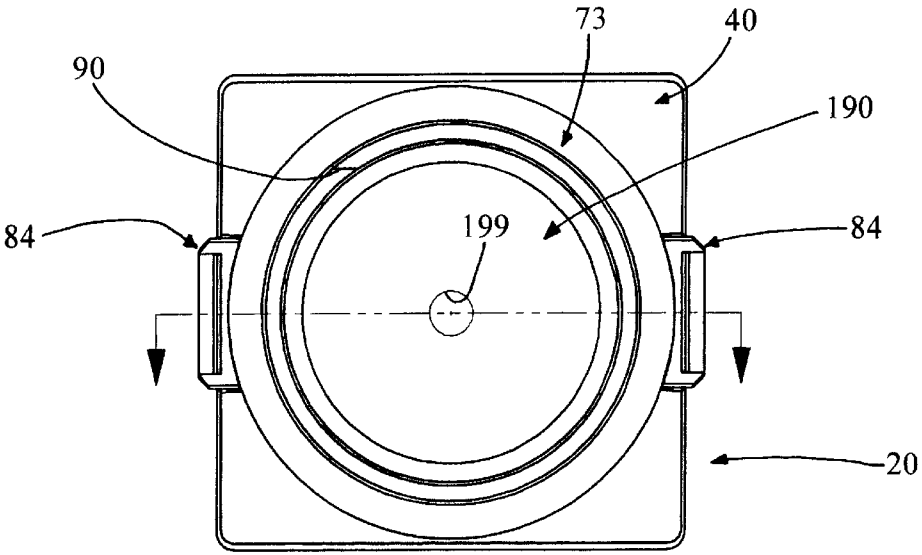
FIG. 10 is a top view of the lamp case with the lens fully assembled thereto.
Figure 12:
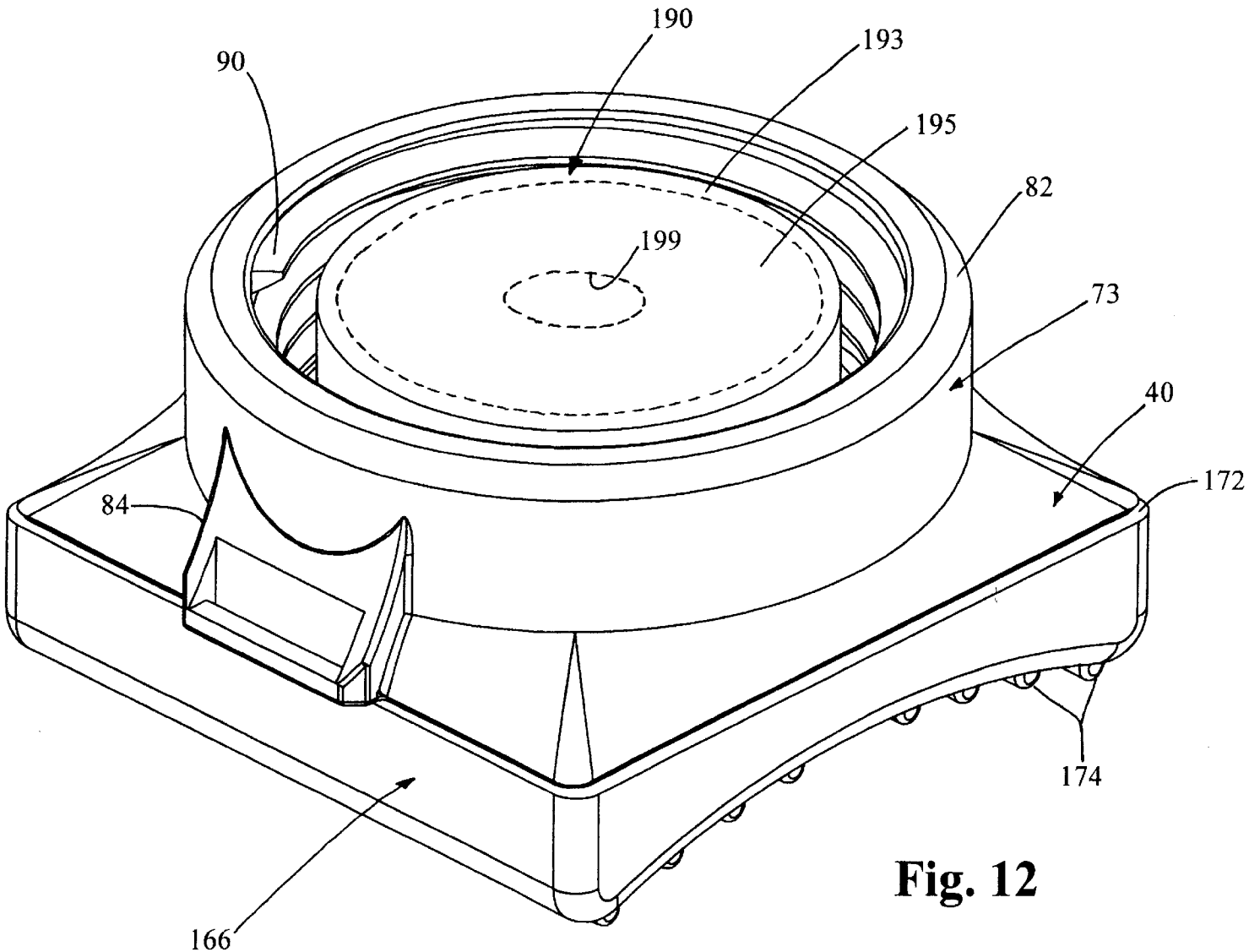
FIG. 12 is a perspective view of a fully assembled lamp case.

Lens housing 190 is then assembled to lamp case 20. More particularly, lens housing 190 is first oriented so that second circular edge 197 is positioned in confronting relation to central bottom surface 66 of lamp case 20. In this position, centrally positioned through-bore 199 of reflector 195 is arranged in confronting coaxial relation with central bore 64 of lamp case 20. Lens housing 190 is then moved toward lamp case 20 so that as lens housing 190 enters bottle receptacle 45, second circular edge 197 of lens housing 190 slides inwardly of constant diameter portion 120 of cylindrical flange 75 (FIG. 11). Lens housing 190 is moved toward bottom surface 66 until circumferential shoulder 198 engages the top of cylindrical flange 75. In this position, first circular edge 196 of cylindrical wall 191 is flush with the outer surface of constant diameter portion 120 of cylindrical flange 75. Additionally, second circular edge 197 is disposed in sealing engagement with recessed groove 115 defined between the lower portion of inner surface 105 and bottom surface 66 of lamp case 20. The sealing engagement between second circular edge 197 and recessed groove 115 may be effected by sealing means, such as, adhesives, heat stacking, press-fitting, ultra-sound bonding, and in other ways known in the art for sealingly engaging two surfaces. In this way, a fluid tight interlocking engagement is permanently created between lens housing 190 and lamp case 20.

A conventional bottle of the type normally carried by campers or backpackers is affixed to lamp case 20 to create bottle lantern 1 in the following manner. More particularly, bottle 10 is oriented so that open end 31 is available for engagement with bottle receptacle 45. It should be noted that bottle 10 may have any amount of liquid within it, or no liquid at all, and still function according to the present invention. Next, fully assembled lamp case 20 is oriented such that transparent face plate 193 of lens housing 190 is disposed in coaxial confronting relation to open end 31 of bottle 10. In this position, cylindrical mouth wall 32 of bottle 10 is arranged in coaxial aligned relation with ramp 125 of cylindrical flange 75. Once in this position, lamp case 20 is moved toward open end 31 of bottle 10 until external thread 34 on cylindrical mouth wall 32 matingly engages thread 90 on the inner surface of cylindrical wall 73. Once in this position, lamp case 20 is rotated (in a conventional sense) so as to engage threads 34 and 90 thereby drawing lamp case 20 into engagement with bottle 10. As this occurs, the free edge of cylindrical mouth wall 32 slides past constant diameter portion 120 of cylindrical flange 75 and engages ramp 125. As bottle 10 engages ramp 125 of cylindrical flange 75, a radially outwardly directed force is generated on cylindrical mouth wall 32 causing cylindrical mouth wall 32 to expand radially outwardly against cylindrical wall 73. In this way, a liquid tight seal is generated at the interface between cylindrical mouth wall 32 and the surface of ramp 125, preventing liquid from within bottle 10 from entering into lamp case 20 or spilling from bottle 10. Of course, bottle lantern 1 may be assembled with bottle 10 being empty, or partially, or nearly completely filled with liquid.

Once bottle 10 is fully assembled to lamp case 20 bottle lantern 1 may be operated by simply depressing radiused actuator pad 176 on concave panel 168 and actuating a push button switch that is interconnected via conventional means to the batteries and light bulb 161. As light bulb 161 energizes, reflector 195 causes the light emitted from light bulb 161 to be directed into the contents of bottle 10. As a result of this advantageous relationship, light from bulb 161 is dispersed in an even manner through the contents of bottle 10 (e.g., air, water, liquid, etc.) and the translucent or transparent walls of bottle 10.

Bottle lantern 1, as assembled, can be either positioned on the ground, a rock, or hung from a tree branch or other suitable position, in any orientation, in order to provide ambient light to a camping site. Advantageously, when bottle lantern 1 is positioned such that lamp case 20 is oriented below bottle 10, all of the light generated by light bulb 161 is emitted and dispersed into the ambient environment. It should be noted that bottle lantern 1 may also be used "hands free" by a camper or backpacker, by using straps suitably affixed to lamp case 20 via strap cleats 84. In this way, bottle lantern 1 may be disposed on a camper's or backpacker's person, e.g., backpack, belt, arm, leg, or forehead, etc.

In order to disassemble bottle lantern 1 the foregoing steps are reversed.

It is to be understood that the present invention is by no means limited only to the particular constructions herein disclosed and shown in the drawings, but also comprises any modifications or equivalents within the scope of the claims.

What is claimed is:

1. A portable lighting device comprising:

a water bottle having an open end and formed of a light transmitting materia, a lamp case releasably fitted to the open end of the water bottle said lamp case including a base having a bottle receptacle for releasably engaging said bottle formed on a first side of said base and a battery receptacle formed on a second side of said base, said base further comprising a rectangularly shaped wall having a top side and an annular groove defined in a perimeter edge so as to form an annular shoulder and further wherein a centrally positioned through-bore is defined in a central bottom surface of said base, with an inner annular shoulder spaced radially-away from the edge of said central bore;

a light bulb positioned within the lamp case; and a light transmitting lens positioned between the light bulb and the interior of the water bottle whereby light emitted from the light bulb is transmitted through the lens to the interior of the water bottle and is diffused through the wall of the water bottle.

2. The portable lighting device according to claim 1 wherein said bottle receptacle includes (i) a cylindrical wall projecting outwardly from said first side of said base and disposed in radially spaced-relation to said edge of said central bore and said inner annular shoulder, and (ii) a cylindrical flange.

3. The portable lighting device according to claim 2 wherein said cylindrical wall circumscribes said central bottom surface so as to define an internal diameter that is sized and shaped to receive said open end of said bottle, and further includes an outer surface having a chamfered external edge and an inner surface having a thread that matingly corresponds to a thread disposed on said open end of said bottle.

4. The portable lighting device according to claim 3 wherein a pair of strap cleats are formed in diametrically opposing relation to one another on said outer surface of said base for carrying or mounting.

5. The portable lighting device according to claim 2 wherein said cylindrical flange is constructed so as to project outwardly from said first side of said base in annular relation to said central bottom surface and having (i) an outer surface including a constant diameter portion and a gradually increasing diameter portion that defines a ramp and (ii) an inner surface extending from an outer edge to a top side with a recessed groove defined between a lower portion of said inner surface and said central bottom surface of said base wherein the diameter of said outer surface is smaller than the inner diameter of said cylindrical wall.

6. The portable lighting device according to claim 1 wherein said battery receptacle includes a peripheral wall, a plurality of semicylindrically shaped recesses, and a wiring island.

7. The portable lighting device according to claim 6 wherein said peripheral wall projects outwardly from said perimeter edge of said base and is disposed in radially spaced relation to said edge of said central bore so as to form a curved perimeter edge surrounding said semicylindrical recesses.

8. The portable lighting device according to claim 7 wherein said annular shoulder of said base is disposed on said outer surface of said peripheral wall, and further wherein said plurality of semicylindrically shaped recesses are defined in said bottom surface of said base in paired parallel-relation to one another, with said wiring island positioned between said pairs of recesses.

9. The portable lighting device according to claim 7 comprising a plurality of semicylindrical bosses provided at least one end of said semicylindrical recesses so as to create a uniform transition between the edges of cylindrical batteries positioned within a portion of said recesses and said peripheral wall during operation of said bottle lantern.

10. The portable lighting device according to claim 7 wherein said central bore opens through the center of said wiring island and structural means are provided integral with said wiring island and adjacent to said edge of said central bore for receiving a light bulb collet and a push button switch.

11. The portable lighting device according to claim 10 wherein said light bulb collet comprises a cylindrical housing that is adapted to receive and support a light bulb, said housing defining a diametrically aligned slot positioned at one end and means for receiving said light bulb at the other end, wherein said slot is sized to receive a portion of a wiring header comprising a wire receptacle and a wire guide, said wiring receptacle having a shape and size so as to be slidingly received within said slot and a pair of bores formed in a top surface that open onto side surfaces of said wire receptacle, said wire guide projects outwardly from a portion of said wire receptacle in perpendicular-relation to said wire receptacle.

12. The portable lighting device according to claim 1 comprising a battery cover having a resilient side wall, a concave panel and an inner surface wherein said sidewall projects from a perimeter edge of said concave panel so as to be adapted for slipping over an edge portion of said battery receptacle.

13. The portable lighting device according to claim 12 wherein said side wall defines a perimeter of a recessed area bounded on four sides by said side wall and having a bottom defined by said concave panel so as to receive and cover said battery receptacle.

14. The portable lighting device according to claim 13 wherein said side wall includes a radially inwardly directed bulbous projection disposed adjacent to an inner side of a free edge thereof and wherein said concave panel includes on an outer surface a plurality of transversely oriented ribs.

15. The portable lighting device according to claim 1 comprising a lens housing sealingly attached to said lamp case so as to be positioned within a portion of said open end of said water bottle, said lens housing including a cylindrical wall, a transparent face plate, and a reflector.

16. The portable lighting device according to claim 15 wherein said cylindrical wall includes a first circular edge, a second circular edge, and a circumferential shoulder formed in an outer surface of said cylindrical wall with said transparent face plate sealingly secured to said first circular edge of said cylindrical wall, and said reflector including a centrally positioned through bore adapted to receive a light bulb and being positioned within said lens housing so as to be disposed in confronting relation to said transparent face plate.

17. A portable lighting device comprising a water bottle having an open end and formed of a light transmitting material;

a lamp case including a base having a bottle receptacle for releasably engaging said water bottle, said bottle receptacle comprising a cylindrical wall projecting outwardly from a first side of said base and disposed in radially spaced-relation to an edge of a central bore formed in said base and a cylindrical flange wherein said cylindrical wall circumscribes said central bore so as to define an internal diameter that is sized to be sealingly attached to a lens housing having a cylindrical wall and said open end of said bottle and wherein said cylindrical flange projects outwardly from said first side of base in annular relation to said central bore and having (i) an outer surface including a constant diameter portion and a gradually increasing diameter portion that defines a ramp so that said open end of said water bottle slides past said cylindrical flange and engages said ramp a radially outwardly directed force is generated on said open end causing said open end to press outwardly against said cylindrical wall so as to sealingly engage said lamp case thereby creating a substantially liquid tight seal;

a light bulb positioned within said central bore and interconnected to means for selectively providing electrical power to said light bulb;

and a light transmitting lens positioned between the light bulb and the interior of the water bottle whereby light emitted from the light bulb is transmitted through the lens to the interior of the water bottle and is diffused through the wall of the water bottle.

18. A portable lighting device comprising:

a bottle having an open end defined by a cylindrical free edge and formed of a light transmitting material;

a lamp case releasably fitted to said cylindrical free edge of said bottle said lamp case including a bottle receptacle comprising an outer cylindrical wall and an inner cylindrical flange each projecting outwardly from a first side of said case in spaced-apart concentric relation to one another wherein said inner cylindrical flange includes an outer surface having a gradually increasing diameter portion that defines a ramp such that as said cylindrical free edge of said bottle is received between said outer cylindrical wall and said inner cylindrical flange and engages said ramp a radially outwardly directed force is generated on said cylindrical free edge of said bottle thereby causing said cylindrical free edge to expand radially outwardly against said outer cylindrical wall so that a water tight seal is created at the interface between said bottle and said lamp case thus preventing spillage from said bottle;

a light bulb positioned within said lamp case; and a light transmitting lens positioned between the light bulb and the interior of the bottle whereby light emitted from the light bulb is transmitted through the lens to the interior of the bottle and is diffused through the wall of the bottle.

* * * * *